United States Patent [19]

McKeefery

[11] Patent Number: 4,696,653

[45] Date of Patent: Sep. 29, 1987

[54] SPEAKING TOY DOLL

[75] Inventor: James McKeefery, Milpitas, Calif.

[73] Assignee: Worlds of Wonder, Inc., Fremont, Calif.

[21] Appl. No.: 827,812

[22] Filed: Feb. 7, 1986

[51] Int. Cl.[4] ..... A63H 3/28

[52] U.S. Cl. ..... 446/175; 446/303; 434/308

[58] Field of Search ..... 446/303, 297, 298, 175, 446/484, 300, 301, 397, 302; 434/262, 267, 270, 271, 308

[56] References Cited

U.S. PATENT DOCUMENTS

| | | | |
|---|---|---|---|
| 3,949,488 | 4/1976 | Welch | 434/308 X |
| 4,221,927 | 9/1980 | Dankman et al. | 446/297 X |
| 4,305,223 | 12/1981 | Ho | 446/484 X |
| 4,348,191 | 9/1982 | Lipsitz et al. | 446/297 X |
| 4,451,911 | 5/1984 | Klose et al. | 446/484 X |

FOREIGN PATENT DOCUMENTS

| | | | |
|---|---|---|---|
| 3345978 | 6/1985 | Fed. Rep. of Germany | 446/297 |

*Primary Examiner*—Mickey Yu

*Attorney, Agent, or Firm*—Blakely, Sokoloff, Taylor & Zafman

[57] ABSTRACT

A toy doll which responds with spoken words and/or sentences to the touching of selected portions of the doll by a user and/or voice actuation by the user is described. Specific areas of the doll, such as eyes, ears, nose, etc. are provided with touch switches. When one of the switches is activated, the doll responds with one of two randomly selected sentences related to that part which was touched e.g. "that's my nose", "do you like my nose". In addition, voice actuation is provided by a microphone located within the doll. When the user speaks to the doll, the microphone senses the speech. After the speech has stopped for a fixed period of time (usually one second) the doll responds with a randomly selected sentence. Audio responses are stored via ROM in circuitry within the doll. The vocabulary of the doll can be changed or enlarged with additional ROM's. In order to conserve power, a gravity switch is provided to turn the doll on when the doll is placed in a sitting position or otherwise moved. If the doll is not moved, or receives no touch or voice stimulation after three minutes, the power is turned off.

8 Claims, 5 Drawing Figures

SPEAKING TOY DOLL

BACKGROUND OF THE INVENTION

1. Field of the Invention

This invention relates to the field of toy dolls, and in particular, talking dolls.

2. Background Art

In an effort to produce a toy doll or figure which will appear more lifelike to a user such as a child, the prior art has utilized various systems for producing speech or other sounds from the figures. Typical of these are mechanical sound producing devices which produce sounds in response to compression or other movement of the figure by the child or means for selecting randomly selected pre-recorded messages in response to activation by the user.

More recently, dolls have been designed which provide vocal responses dependent upon the movement of particular appendages, (Tepper et al., U.S. Pat. No. 3,755,960) and dolls which have articulated face movements and automatic movement of arms and legs in conjunction with prerecorded speeches (Noll, U.S. Pat. No. 3,685,200)..

With the advent of relatively low priced integrated circuits, dolls having a digitally synthesized voice have been produced. One such doll is disclosed in Stowell et al., U.S. Pat. No. 4,318,245 (1982). The doll of Stowell includes a digital controller which stores a plurality of sounds. The digital controller is coupled to a speech synthesizer and the various sounds are produced through a speaker in response to signals produced by a motion detector which changes in response to movement of the doll. The doll of Stowell produces sounds which are generated by frequency of motion of the doll. The sounds produced do not relate directly to the position of the doll but rather to the movement the doll is undergoing. This has the disadvantage of requiring the child to constantly move the doll in order to produce a sound. Additionally, the sounds produced by the doll are not easily reproducible in the doll by the user, the sounds being independent of doll position and being related to frequency of motion. Finally, no doll has been produced which responds to spoken words.

Therefore, it is the principal object of the present invention to provide a talking doll or toy which produces spoken words or phrases based on touching certain areas of the doll or in response to spoken words.

Yet another object of the present invention is to provide a talking doll or toy which will reduce the power consumed when the doll or toy is stationery for a certain period of time.

BRIEF SUMMARY OF THE INVENTION

A toy doll which responds with spoken words and/or sentences to the touching of selected portions of the doll by a user and/or voice actuation by the user is described. Specific areas of the doll, such as eyes, ears, nose, etc. are provided with touch switches. When one of the switches is activated, the doll responds with one of two randomly selected sentences related to that part which was touched e.g. "that's my nose", "do you like my nose". In addition, voice actuation is provided by a microphone located within the doll. When the user speaks to the doll, the microphone senses the speech. After the speech has stopped for a fixed period of time (usually one second) the doll responds with a randomly selected sentence. Audio responses are stored via ROM in circuitry within the doll. The vocabulary of the doll can be changed or enlarged with additional ROM's. In order to conserve power, a gravity switch is provided to turn the doll on when the doll is placed in a sitting position or otherwise moved. If the doll is not moved, or receives no touch or voice stimulation after three minutes, the power is turned off.

DETAILED DESCRIPTION OF THE INVENTION

Figure 1:
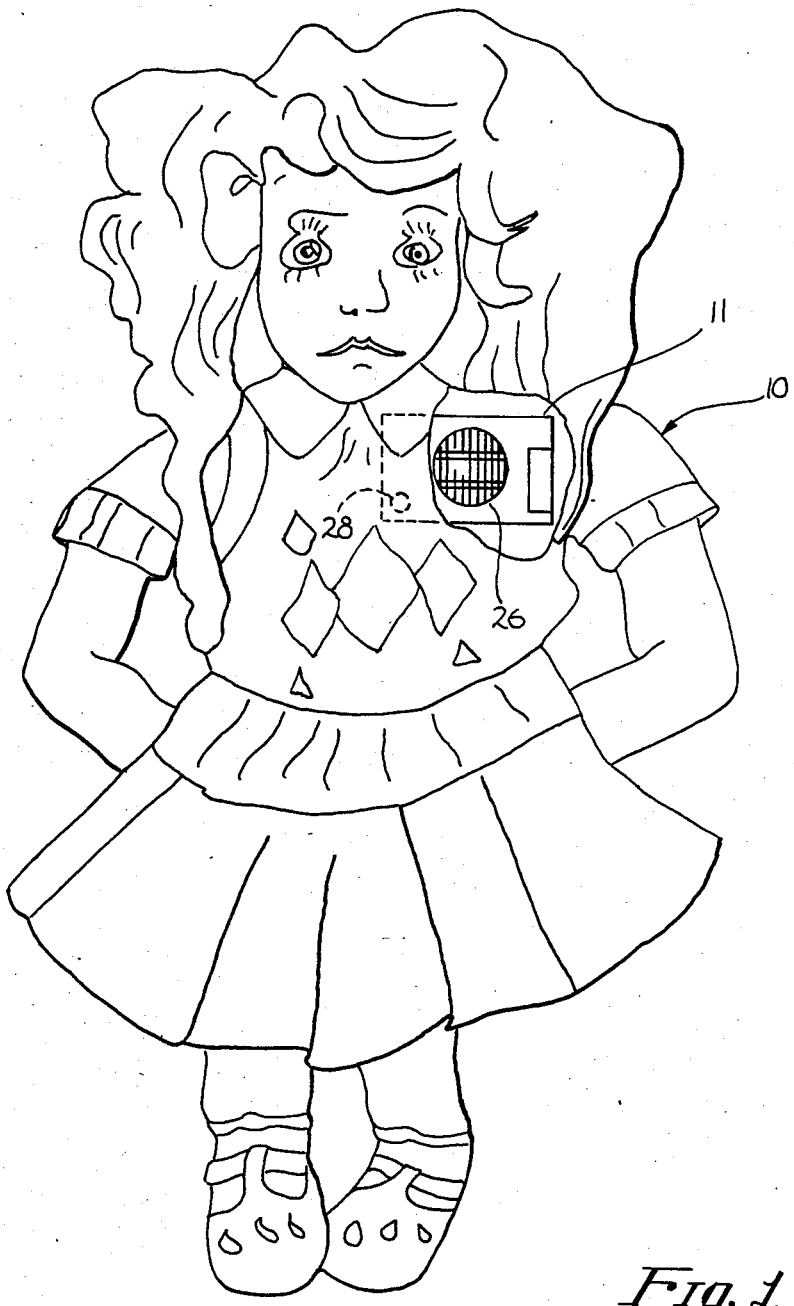
FIG. 1 illustrates a toy doll having a speaker and microphone contained therein as in the preferred embodiment of the present invention.

Referring to FIG. 1, the preferred embodiment of the present invention is illustrated. A toy doll 10 has contained within it, in the upper left shoulder, a microphone/speaker assembly 11. The assembly 11 includes a speaker 26 and a microphone 28. In addition, touch sensitive switches are disposed beneath the eyes, ears, nose, mouth, cheek, head and tummy of the doll. The switch for the nose is shown in detail in FIG. 2. When those areas of the doll are touched, and the switch depressed, the doll, in the preferred embodiment, responds with one of two randomly selected sentences. For example, if a user were to touch the doll on the nose and depress the touch switch located there, the doll might respond with "that's my nose" or, "do you like my nose". In the preferred embodiment of the present invention, the doll responds with a "giggle" when the tummy is depressed or touched.

Figure 2:
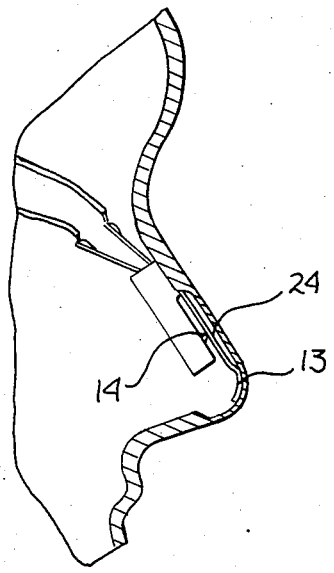
FIG. 2 illustrates a touch switch as utilized in the present invention.

Referring to FIG. 2, an example of a touch switch is illustrated. The switch 24 includes two contacts 13 and 14. In the preferred embodiment of the present invention, contact 13 is an extended member, extending substantially along the length of the front of the nose. In this manner, a user of the doll may touch the doll on the nose at almost any location and still get a response.

Figure 3:
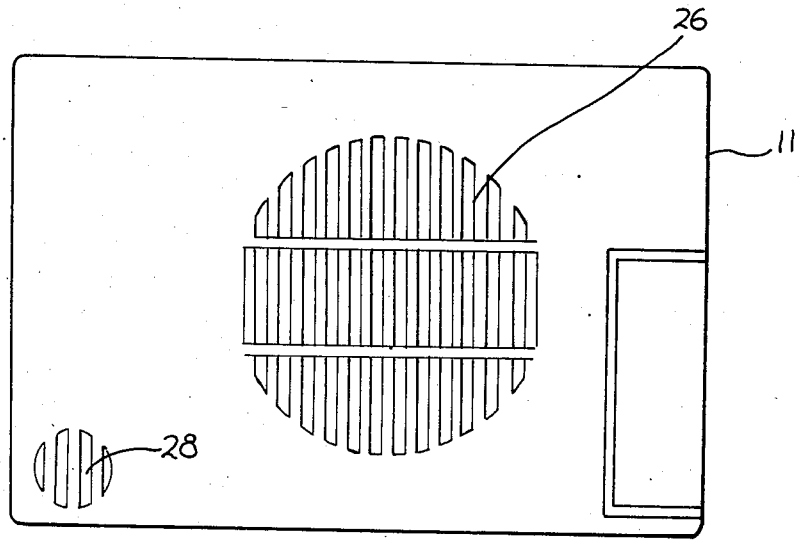
FIG. 3 illustrates the microphone/speaker combination of the present invention.

In order to enhance the lifelike nature of the doll of the present invention, and to increase the enjoyment of users of the doll, means have been provided so that the doll may respond to spoken words. Referring to FIG. 3, the microphone/speaker assembly 11 is illustrated. When a user talks to the doll, the microphone 28 is activated, producing a signal and causing a response to a be randomly selected. Timing means provided to determine when the voice stimulation of the microphone has ceased for a fixed period of time. In the preferred embodiment of the present invention, when a user has stopped speaking for approximately one second, the randomly selected response is produced from the speaker 26.

Figure 4:
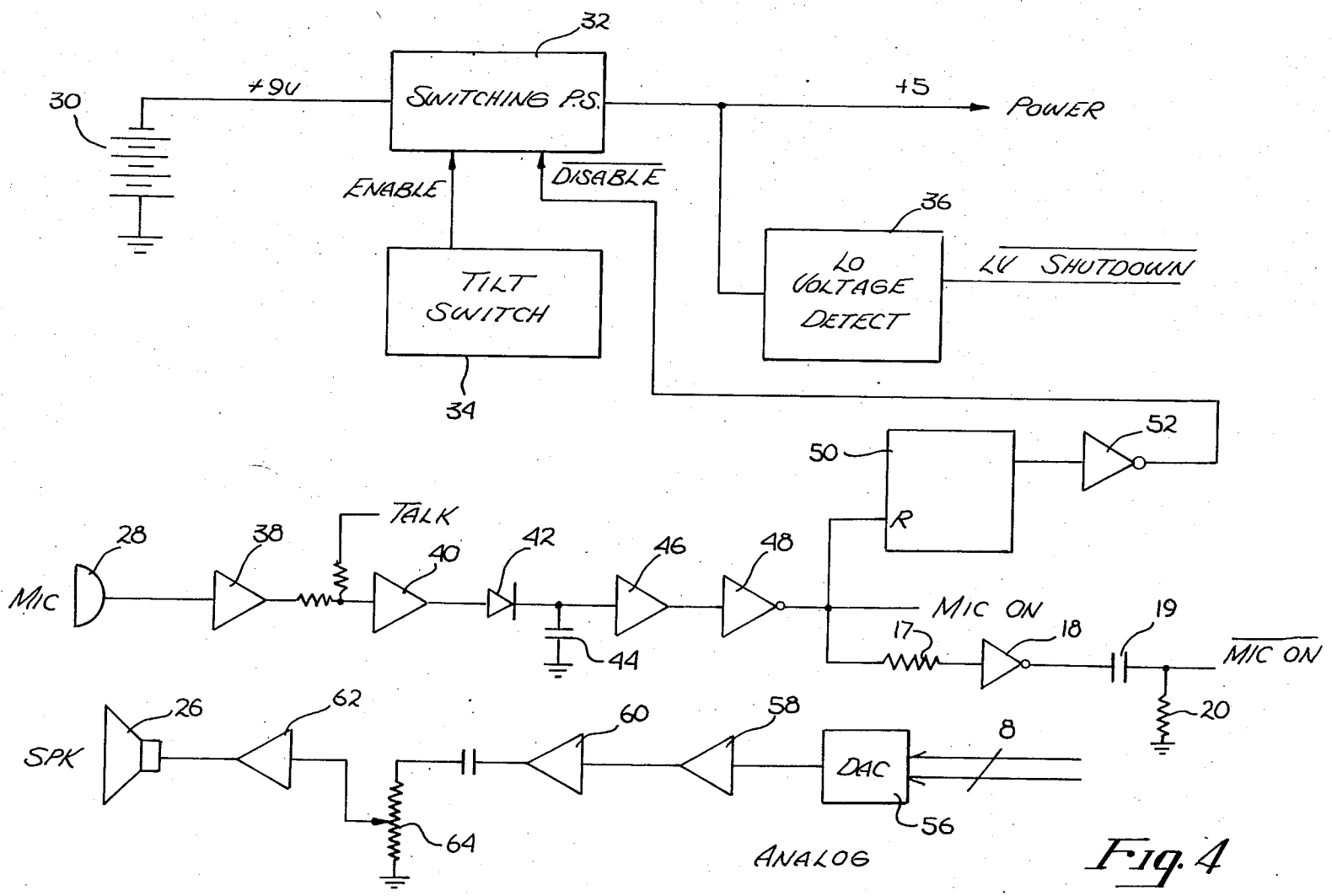
FIG. 4 is a block diagram illustrating a portion of the circuitry of the present invention.
Figure 5:
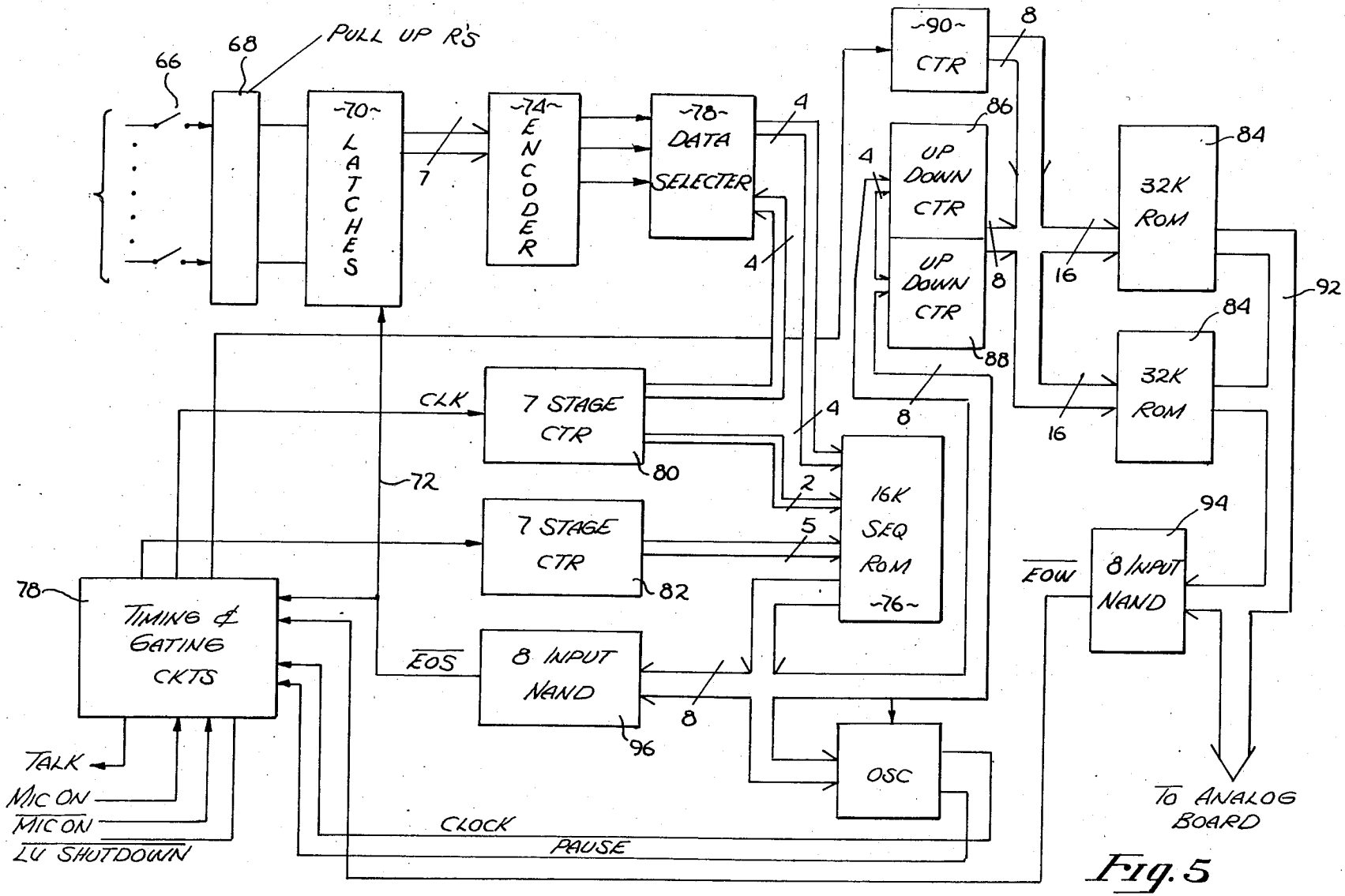
FIG. 5 is a block diagram illustrating another portion of the circuits of the present invention.

Now referring to FIGS. 4 and 5, block diagrams for the circuits of the doll of FIG. 1 may be seen. In the preferred embodiment two circuit boards are provided, the circuit board of FIG. 4 being referred to as the analog board and the circuit board of FIG. 5 being referred to as the digital board. As may be seen in FIG.

4, the analog board includes a battery power supply 30, preferably a nine volt transister battery, coupled to a switching power supply 32 to provide power to both the analog and additional boards. The main power for the system is +5 volts in accordance with standard logic power levels, the switching power supply 32 being used to provide an efficient conversion of the nine volt battery voltage to the five volt logic level. The switching power supply 32 includes an electronic turn on and turn off capability, the power supply being turned on by a pulse created by a tilt switch 34 in the doll responsive to motion or orientation with respect to gravity to turn on the switching power supply 32 with the power supply automatically turning off as shall subsequently be seen, preferably after approximately three minutes of inactivity to preserve the battery without requiring a manually operable on/off switch. In that regard, the tilt switch itself is coupled to a pulse circuit so that the tilt switch remaining in the closed position will not in itself maintain the switching power supply 32 on beyond the predetermined level period of inactivity required for the automatic shutoff. Also, as shown in FIG. 4, a low voltage detect circuit 36 is provided to provide a low voltage shut down signal, a negative logic signal used by the digital board to disable the speech capability thereof rather than allowing a low voltage condition to result in garbled words and other malfunction of the circuit.

The analog board is also connected to microphone 28, the output of which is amplified by amplifier 38 and inverting amplifier 40 to be rectified by direct diode 42 and capacitor 44. The DC voltage on capacitor 44 in turn is amplified by inverting amplifiers 46 and 48 to provide the MIC ON signal at the output of the inverting amplifier 48. The MIC ON signal is coupled to amplifier 18 through resistor 17. The output amplifier 18 is coupled to capacitor 19 whose output, acted on by pull down resistor 20, is $\overline{\text{MIC ON}}$, the complement of MIC ON. The MIC ON signal of course, or more appropriately, the absence of the MIC ON signal, is indicative of the inactivity of the doll. Accordingly, the MIC ON signal is provided to a 14 stage ripple carry binary counter divider 50 which, if not reset by the MIC ON signal going high within approximately three minutes, provides the disable signal (a negative logic signal) to inverter 52. The signal coupled to the inverter 52 is the signal from the last stage of counter 50, the signal from the next to the last stage being provided through the RC network to inverter 54 to generate a Pre-Time Out signal, a negative logic signal, the function of which will be subsequently described.

Finally, the analog board includes a digital to analog converter 56 for converting an eight bit binary coded signal provided thereto from the digital board to an analog signal amplified by amplifiers 58 and 60 to drive power amplifier 62 to a volume control 64 manually adjustable under the clothing of the doll to control the volume of the speech provided by speaker 26.

Now referring to FIG. 5, a block diagram of a digital portion of the circuit may be seen. In the preferred embodiment, seven touch switches 66 are provided for providing seven touch punch inputs from various areas on the doll 10 of FIG. 1, specifically, eyes, ears, nose, mouth, cheek, head and tummy. (The switch 24 of FIG. 2 is one of these switches). The purpose of the circuit of course is to provide sentences, synthesized words, responsive to and even tailored to the body location of the switch signal which was activated. By way of example, when the nose switch of FIG. 2 is activated by touching the doll on the nose, the doll will respond with one of two randomly selected sentences, specifically, "That's my nose" or "Do you like my nose?". When the tummy is touched, by way of further example, the doll merely responds with a giggle, which of course for purposes of the disclosure is considered a word and of course may be synthesized like any other English language or foreign language word. In general one side of each of switches 66 is tied to ground and accordingly pullup resistors schematically illustrated by pullup resistors 68 are used to maintain the open switch high so that the switch closure may be detected by the respective line going low. The seven switch signals are provided to latches 70 which latch the state of the seven switches. In general, the latches 70 are clocked until a switch closure is detected which will initiate the speech synthesizing circuitry and disable the clocking of the latches until an end of sentence AOS signal is received on line 72. The output of the seven latches 70 are coupled to an encoder 74 which converts the individual signals to a binary code provided as four bits of the address to a 16K (2K by 8) sequencing ROM 76 to a data selector 78. These four bits perform the upper or four most significant bits of the eleven bit address of the ROM, the other seven bits being provided by the timing and gating circuits 78 appropriately controlling counters 80 and 82. Note that the net result of this connection is that the switch settings essentially wind up pointing to different segments of the memory 76 with the counters coming up from the start of each segment sequentially through the segment until the end of the sentence being pointed to is reached.

In essence, the sequencing ROM 76 contains sequences of binary coded numbers representing the desired word sequences of the various sentences to be spoken by the system. The binary numbers representing starting address segments for 32K ROM 84 in which the digital representation of the words themselves are stored. Thus as may be seen in FIG. 5, the eight bit wide output of the sequencing ROM 76 is coupled so that respective four bits thereof are provided to each of the up/down counters 86 and 88 at the jammed inputs or parallel inputs thereto. These counters therefore are set to count representing the starting point from the address portion again the most significant bit of the eight bit address portion of ROM 84 where each of the digitized words starts. The remainder of the address portion, specifically the lower bits thereof, is provided by counter 90 which when clocked at the sample rate of the words will clock out the digitized word on bus 92 coupled to the analog board, specifically the digital to analog converter 56. In the preferred embodiment the overflow of counter 90 is coupled to counter 86 with the overflow thereof coupled to counter 88 so that the number of samples per word can be relatively high. In that regard in the preferred embodiment, a sampling rate of 8 Kh is used when digitizing the analog voice signal with the clocking rate of counter 90 of course being the same to clock out the previously stored samples at the same rate for "play back" of the word.

The sequencing ROM 76 as well as the digitized word storage ROM 84 have an eight bit output and accordingly can provide to the inputs of the sequencing ROM an address segment ranging from zero to 255 and in the case of the word sample storage ROMs 84, a relative digitized word sample ranging from zero to 255. In both cases however, a 255 value (e.g., 11111111) is a reserved value having other significance. In particular, the ROMs 84 and 255 is reserved as representing an end of word EOW which is detected by NAND gate 94 to provide the negative logic end of word signal to timing and gating circuit 78 to cause an appropriate space between words to advance the address from the sequencing ROM to the next word to be spoken to load counter 86 and 88 with the appropriate new partial address as defined by the output of the sequencing ROM to reset counter 90, etc., and of course can initiate the clocking out of the word samples for the next word in sequence. Similarly, 255 digital codes stored in sequencing ROM 76 are detected by NAND gate 96 to provide a negative logic end of sentence (EOS) signal to enable latches 70 to sample the state of switches 66 from another switch if found to be closed and of course to assure an appropriate pause between sentences in all instances.

In the description of FIG. 4, the generation of the positive and negative logic signals for MIC ON was described. These signals are both provided to the timing and gating circuits 78 of the digital board shown in FIG. 5. These signals are used to detect when a child has spoken to the doll and has ceased speaking to the doll for approximately one second to initiate the doll's speaking response. For this purpose a sequencing ROM 76 is provided with a number of sentences of a relatively nonspecific nature, any one of which should be a suitable response with the timing and gating circuits randomly selected at the start of one of those sentences in response to the voice actuation. Finally, as shown in FIG. 5, the timing and gating circuit 78, while controlling the synthesized speech of the system based upon the setting of switches 66 also provides a logic signal TALK which as may be seen in FIG. 4 biases the input of amplifier 40 to clamp the MIC ON signal below the enabling level irrespective of the sound pick up by the microphone so that the doll's own synthesized speech will not itself illicit a voice response.

What is claimed is:

1. A toy comprising:

a body assembly having an at least partially flexible outer covering with an appearance simulating at least some life like features, a plurality of switch means within said body assembly, each of said switch means being covered by said outer covering of one of said life like features so as to provide a switch signal response to a person's touching of the respective life like feature, voice synthesizing means for electrical synthesizing any of a plurality of words responsive to control signals provided thereto, said voice sythesizing means including speaker means for audibilizing said electronically synthesized words, and sequencing means coupled between said plurality of switch means and said voice synthesizing means, said sequencing means being a means for providing a sequence of control signals to said synthesizing means responsive to said switch means to cause said synthesizing means to synthesize a sequence of words responsive to which said switch means provided a switch signal, a battery power supply, a gravity switch means and a power coupling means, said power coupling means being coupled to said battery power supply, said gravity switch means, said voice synthesizing means and said sequencing means, said gravity switch means being responsive to motion and orientation with respect to gravity to provide a tilt switch signal to said power coupling means, said power coupling means being a means for coupling power to said voice synthesizing means and said sequencing means responsive to said tilt switch signal, said power coupling means being responsive to said voice synthesizing means so as to decouple power to said voice synthesizing means and said sequencing means upon the prolonged absence of a synthesized word therein, a microphone in said body assembly coupled to said sequencing means, said microphone being responsive to sounds orriginating from other than said toy, said sequencing means also being responsive to said microphone to cause said synthesizing means to synthesize a sequence of words upon said microphone detecting sounds followed by an apparent absence of sounds for a predetermined period of time, said power coupling means coupled to said microphone, said power coupling means being responsive to said microphone so as to decouple power to said voice synthesizing means upon the prolonged absence of activation of said microphone.

2. The toy of claim 1 wherein said power coupling means is responsive to said voice synthesizing means whereby said power coupling means will decouple said battery power supply upon the prolonged absence of operation of said voice synthesizing means.

3. The toy of claim 2 wherein said power coupling means comprises a switching power supply to convert the voltage of said battery power supply to another predetermined voltage.

4. The toy of claim 1 wherein said voice synthesizing means comprises a clocking means, a first read only memory, to a digital to analog converter and a speaker, said first read only memory having stored sequentially therein binary coded numbers representing sequentially equally time spaced samples of a voice amplitude for each respective word, said clocking means being a means for sequentially clocking said binary coded numbers out of said memory, at least for a single word at a time said digital to analog converter being coupled to said first read only memory to convert the output thereof to an analog signal, and said speaker being coupled to said digital to analog converter means to convert the output signal thereof to an audible sound.

5. The toy of claim 4 wherein said sequencing means includes a second read only memory, said second read only memory having stored therein digital form and in sequence, partial addresses representing in part the address of the first binary coded number of each respective word of one of said sequence of words, said second read only memory being coupled to said plurality of switch means and also being coupled to said first read only memory, whereby said second read only memory and said clocking means together will cause read on the clocking of each part of each successive word out of said first memory dependent on which of said plurality of switch means is providing switch signal.

6. The toy of claim 5 wherein each word stored in said first read only memory ends with an end of word code, and wherein said sequencing means includes means for pausing upon dilution of said end of word code prior to sequentially clocking said binary coded numbers for the next word out of said first memory.

7. The toy of claim 6 wherein said second read only memory includes coded information that causes control of pause duration as well as word pitch and amplitude.

8. The toy of claim 7 wherein each sequence of words stored in said second read only memory ends with an end of sentence code, and wherein said sequencing means is not responsive to said switch means until a prior sentence is completed as indicated by said end of sentence code.

* * * * *